US010986440B2

(12) United States Patent
Hu et al.

(10) Patent No.: US 10,986,440 B2
(45) Date of Patent: Apr. 20, 2021

(54) EARBUD

(71) Applicant: Goertek Inc., Weifang (CN)

(72) Inventors: Caiyun Hu, Weifang (CN); Hongmei Wang, Weifang (CN); Xiaoli Zhao, Weifang (CN); Kaibo Xing, Weifang (CN); Huijin Chen, Weifang (CN)

(73) Assignee: GOERTEK INC.

( * ) Notice: Subject to any disclaimer, the term of this patent is extended or adjusted under 35 U.S.C. 154(b) by 0 days.

(21) Appl. No.: 16/621,180

(22) PCT Filed: Jun. 25, 2019

(86) PCT No.: PCT/CN2019/092615
§ 371 (c)(1),
(2) Date: Dec. 10, 2019

(87) PCT Pub. No.: WO2020/082767
PCT Pub. Date: Apr. 30, 2020

(65) Prior Publication Data

US 2020/0145749 A1 May 7, 2020

(30) Foreign Application Priority Data

Oct. 26, 2018 (CN) ..... 201811257033.9

(51) Int. Cl.
*H04R 1/10* (2006.01)
*H04R 1/28* (2006.01)

(52) U.S. Cl.
CPC ..... *H04R 1/2826* (2013.01); *H04R 1/1016* (2013.01); *H04R 1/1075* (2013.01);
(Continued)

(58) Field of Classification Search
CPC ..... H04R 2400/07; H04R 2460/11
See application file for complete search history.

(56) References Cited

U.S. PATENT DOCUMENTS 8,879,768 B2 * 11/2014 Podoloff ..... H04R 1/1041 381/373
8,989,425 B2 * 3/2015 Hua ..... H04R 1/1075 381/373

(Continued)

FOREIGN PATENT DOCUMENTS

CN 103475968 A 12/2013
CN 104244130 A 12/2014

(Continued)

*Primary Examiner* — Thang V Tran
(74) *Attorney, Agent, or Firm* — Clark Hill PLC; James R. Foley

(57) ABSTRACT

An earbud comprises: a casing in which a sound cavity is provided; a speaker disposed in the sound cavity and dividing the sound cavity into a front sound cavity and a rear sound cavity; and an acoustic structure located in the rear sound cavity. The acoustic structure comprises a first sound guiding wall and a cover plate, the first sound guiding wall is attached to a bottom surface of the rear sound cavity and is configured to, together with at least a part of an inner wall of the casing, constitutes a sound guiding groove, and the cover plate is mounted at an upper opening part of the sound guiding groove, such that the sound guiding groove forms a bass pipe which communicates from the rear sound cavity to at least one aperture of the casing.

17 Claims, 2 Drawing Sheets

(52) U.S. Cl.
CPC ..... *H04R 1/1041* (2013.01); *H04R 2420/07* (2013.01); *H04R 2460/11* (2013.01)

(56) References Cited

U.S. PATENT DOCUMENTS

| | | | | |
|---|---|---|---|---|
| 9,654,865 | B2 * | 5/2017 | Zhao | H04R 1/2876 |
| 9,942,648 | B2 * | 4/2018 | Azmi | H04R 1/2826 |
| 2013/0343593 | A1 * | 12/2013 | Howes | H04R 1/20 381/380 |
| 2015/0382100 | A1 | 12/2015 | Azmi et al. | |
| 2016/0219360 | A1 | 7/2016 | Zhao et al. | |

FOREIGN PATENT DOCUMENTS

| | | | |
|---|---|---|---|
| CN | 106028188 | A | 10/2016 |
| CN | 205754845 | U | 11/2016 |
| CN | 106954117 | A | 7/2017 |
| CN | 206698398 | U | 12/2017 |
| CN | 207304847 | U | 5/2018 |
| CN | 109618257 | A | 4/2019 |
| EP | 3264791 | A1 | 1/2018 |
| WO | 2016/166785 | A1 | 10/2016 |

* cited by examiner

EARBUD

CROSS REFERENCE TO RELATED APPLICATIONS

This application is a U.S. National Stage entry under 35 U.S.C. § 371 based on International Application No. PCT/CN2019/092615, filed on Jun. 29, 2019, which claims priority to Chinese Patent Application No. 201811257033.9, filed on Oct. 26, 2018. The embodiment of the priority applications are hereby incorporated herein in their entirety by reference.

TECHNICAL FIELD

The present disclosure relates to the field of acoustics, and in particular, to an earbud.

BACKGROUND

TWS is short for true wireless stereo. TWS Bluetooth earbud (headphones) can realize real wireless separation of Bluetooth left and right channels. Since two ear-hooks of the TWS Bluetooth earbuds need not a cabled connection, the left and right earbuds form a stereo system via Bluetooth, and the functions of listening to songs, making calls, and being worn are all improved.

In the TWS earbuds on the current market, the bass pipe is a separate pipe structure. Due to the comprehensive influence of the thickness of the pipe wall of the bass pipe and the thickness of the earbud casing, a relatively larger part of the internal space of the earbud will be occupied in order to provide a bass pipe with a certain space. Moreover, since the bass pipe is a separate structure, it must be assembled into the earbud in the actual production process, which is fairly difficult; moreover, the acoustic structure is complicated, so the production cost is high and the production yield is relatively lower.

SUMMARY

In view of the above problems, the present disclosure provides an earbud in which a bass pipe is constructed by using an inner wall of the casing and a pre-provided sound guiding wall, which effectively simplifies the design of the bass pipe and reduces the production cost of the earbud.

In order to achieve the above object, the present disclosure adopts the following technical solutions:

One embodiment of the present disclosure provides an earbud, comprising:

a casing in which a sound cavity is provided;

a speaker disposed in the sound cavity and dividing the sound cavity into a front sound cavity and a rear sound cavity; and an acoustic structure located in the rear sound cavity, wherein the acoustic structure comprises a first sound guiding wall and a cover plate, the first sound guiding wall is attached to a bottom surface of the rear sound cavity and is configured to, together with at least a part of an inner wall of the casing, constitutes a sound guiding groove, and the cover plate is mounted at an upper opening part of the sound guiding groove, such that the sound guiding groove forms a bass pipe which communicates from the rear sound cavity to at least one aperture of the casing.

The advantages and beneficial effects of the present disclosure are as follows.

(a) The present disclosure fully takes advantage of the casing structure of the earbud itself, and the bass pipe can be formed only by adding a wall-like structure and a cover plate in the rear sound cavity, which occupies a smaller space compared with the bass pipe of a separate structure in the prior art; moreover, the area of the bass pipe can be effectively increased, and the low frequency sound quality of the earbud can be improved.

(b) The bass pipe of the present disclosure is mainly composed of a wall-like structure attached to the bottom surface of the rear sound cavity and an inner wall of the casing of the earbud, and the cover plate is installed at a later time, thus such a structure is simple to assemble, easy to operate, and sound is not prone to leak, thereby effectively improving the production yield and reducing the production cost of the earbud.

(3) The bass pipe of the present disclosure is provided by effectively making use of the internal space of the casing, thereby reducing the overall size of the finished earbud.

Figure 1:
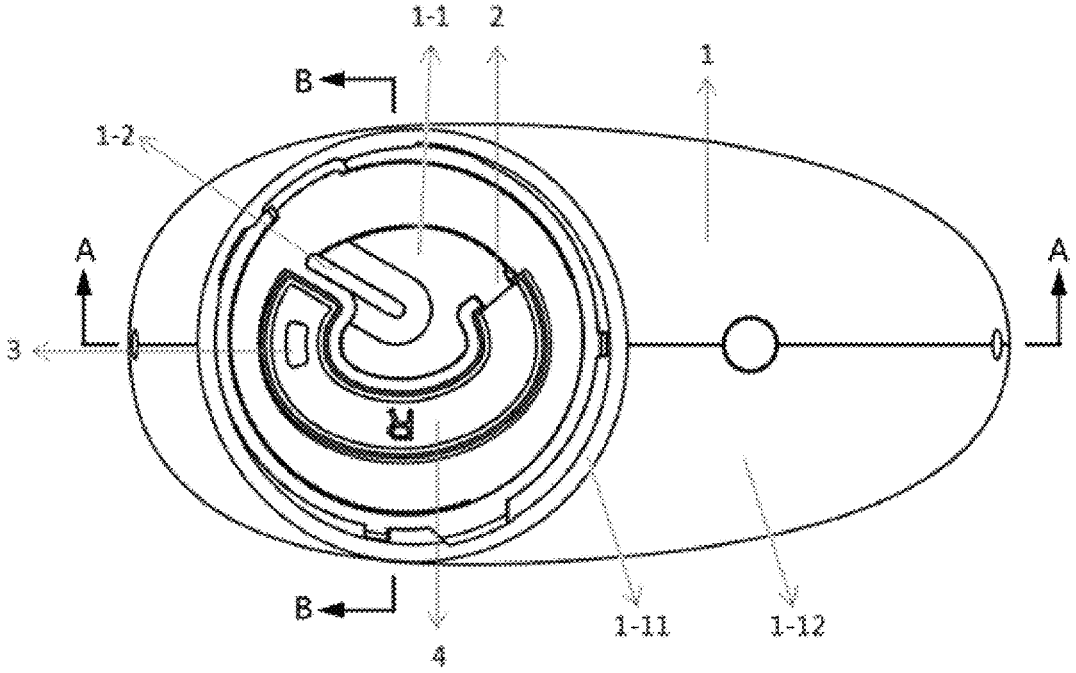
FIG. 1 is a top view of an earbud according to an embodiment of the present disclosure (the casing of the in-ear portion and the speaker of the earbud not illustrated)

1: casing; 1-1: bottom surface of the rear cavity; 1-2: threading hole; 1-3: earbud sound venting hole; 1-4: sound guiding groove; 1-5: wire groove; 1-6: seal solvent storage tank; 1-7: first sound guiding wall; 1-8: second sound guiding wall; 1-9: outer casing; 1-10: inner casing; 1-11: in-ear portion; 1-12: handle portion; 2: bass pipe sound entering hole; 3: tuning mesh; 4: cover plate; 4-1: rear sound cavity sound venting hole; 4-2: step for dispensing an adhesive; 5: isolation mesh; 6: rear sound cavity; 6-1: first sound rear cavity; 6-2: second rear sound cavity; 7: front sound cavity; 8: bass pipe; 9: speaker; 9-1: diaphragm; 9-2: rear sound emitting hole; 10: wire.

DETAILED DESCRIPTION

The technical concept of the present disclosure is as follows. In view of the defects of the stereo earbud in the prior art that the design of the bass pipe is complicated and the production cost is high, the present disclosure provides an earbud, in which the structure of the bass pipe is designed by using a wall-like structure in the rear sound cavity and the inner wall of the casing of the earbud so as to avoid adding an additional acoustic structure, thereby reducing the production cost and assembly difficulty of the earbud, improving the production yield, and providing a more excellent adjustment space for the acoustic performance.

In order to make the objects, technical solutions and advantages of the present disclosure clearer, the embodiments of the present disclosure will be further described in detail below with reference to the accompanying drawings.

First Embodiment

The first embodiment of the present disclosure is illustrated with reference to FIG. 1 to FIG. 4. In the present embodiment, an earbud is provided, which comprises: a casing 1, a speaker 9, and an acoustic structure.

The casing 1 is provided therein with a sound cavity.

The speaker 9 is disposed in the sound cavity, and divides the sound cavity into a front sound cavity 7 and a rear sound cavity 6.

The acoustic structure is located in the rear sound cavity 6. The acoustic structure comprises a first sound guiding wall 1-7 and a cover plate 4. The first sound guiding wall 1-7 is attached to a bottom surface 1-1 of the rear sound cavity, and configured to, together with at least a part of an inner wall of the casing 1, constitutes a sound guiding groove 1-4. The cover plate 4 is mounted at an upper opening part of the sound guiding groove 1-4, such that the sound guiding groove 1-4 forms a bass pipe 8 which communicates from the rear sound cavity 6 to at least one aperture of the casing 1.

Figure 3:
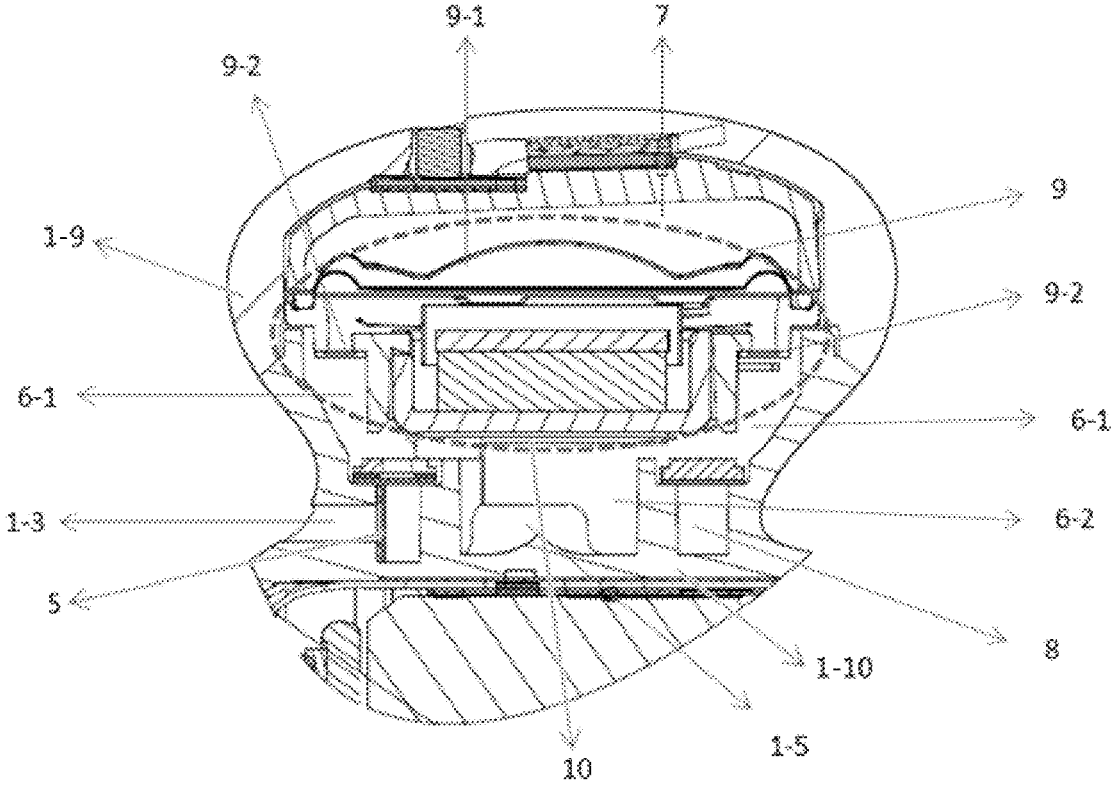
FIG. 3 is a partial cross sectional view taken along line A-A of FIG. 1.

As shown in FIG. 3, the casing 1 includes an outer casing 1-9 of the earbud and an inner casing 1-10 of the earbud. The inner casing 1-10 and the outer casing 1-9 may be integrally formed. The sound cavity is enclosed by the inner casing 1-10 and the outer casing 1-9 of the earbud.

The front sound cavity 7 is located at an end of the speaker 9 where a diaphragm 9-1 is located, and the rear sound cavity 6 is located at an end of the speaker 9 where a yoke is located. The speaker 9 is provided with a rear sound emitting hole 9-2 to communicate with the rear sound cavity 6. When the speaker 9 works, the sound is transmitted towards the rear sound cavity 6 through the rear sound emitting hole 9-2.

The surroundings of the speaker 9 should be sealed against the casing 1 to avoid sound leakage from the surroundings and deterioration of sound quality.

The bottom surface 1-1 of the rear sound cavity is a part of the inner casing 1-10, so the first sound guiding wall 1-7 is attached to the inner casing 1-10. The first sound guiding wall 1-7 and the inner casing 1-10 may be integrally formed in advance. The first sound guiding wall 1-7 and a part of the inner wall of the outer casing 1-9 form a sound guiding groove 1-4. Then a cover plate 4 is provided at the upper opening part of the sound guiding groove 1-4, and thus a bass pipe 8 is formed.

The bass pipe 8 is located in the rear sound cavity 6, with one end communicating with the rear sound cavity 6, and the other end communicating with an aperture in the casing 1, and the aperture communicates with the outside of the earbud. The end communicating with the rear sound cavity 6 acts as the sound entering hole 2 of the bass pipe 8. The sound transmitted from the rear sound cavity 6 can enter the bass pipe 8 via the sound entering hole 2 of the bass pipe, and is transmitted to outside of the casing along the aperture in the casing 1.

The earbud of the present embodiment fully takes advantage of the casing structure of the earbud itself, in combination with a wall-like structure (first sound guiding wall) and the cover plate added in the rear sound cavity, to form a bass pipe as an acoustic structure of the earbud, and can realize the bass sound effects of the earbud. In addition, there is no need to additionally consider the issues in the prior art such as the thickness of the pipe wall of the bass pipe, so the space occupied is reduced, the area of the bass pipe is increased, and the low-frequency sound quality of the earbud can be improved. Moreover, the pipe wall constituting the bass pipe is composed of the inner wall of the casing and the wall-like structure attached to the bottom surface of the rear sound cavity, so only the cover plate needs to be installed during the process of assembly, which greatly reduces the assembly difficulty of the earbud, improves the production yield and reduces the production cost.

The earbud provided in the present embodiment is a wireless stereo earbud, which can make use of Bluetooth communication. The wireless stereo earbud can be further divided into a left earbud and a right earbud in both of which the above mentioned acoustic structure is provided.

Further Optimized Design

Figure 2:
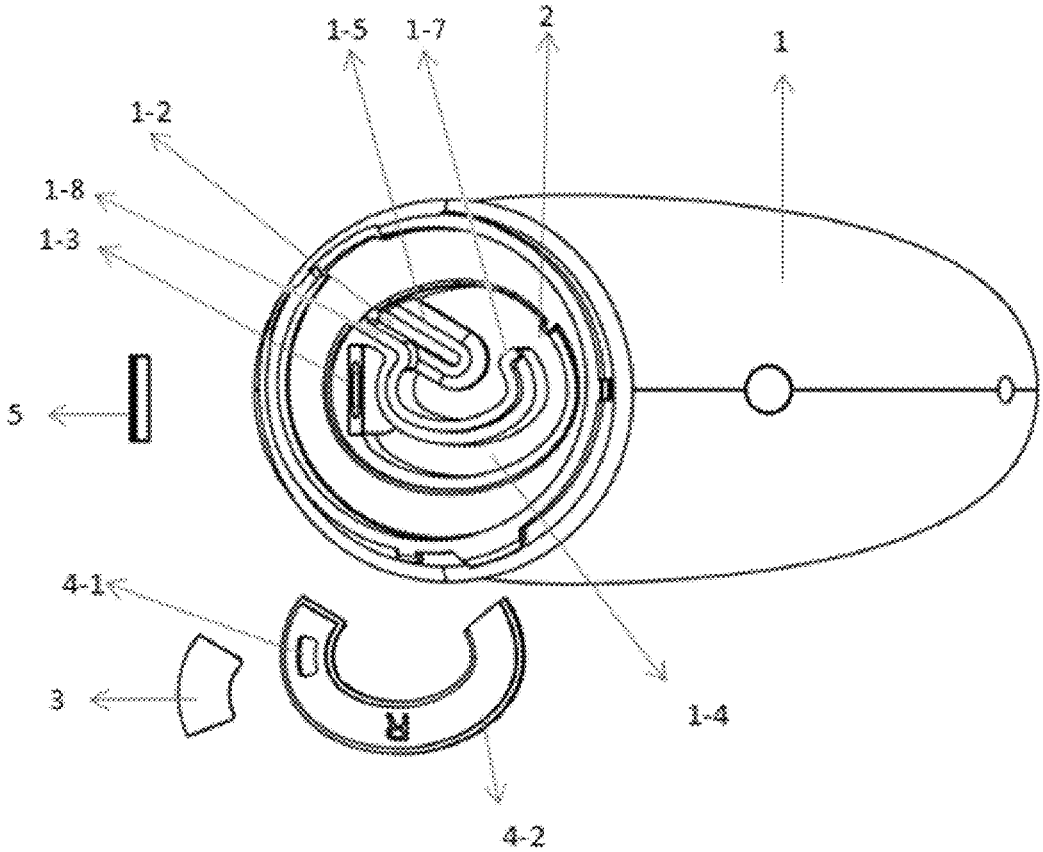
FIG. 2 is an exploded view of an earbud according to an embodiment of the present disclosure (the casing of the in-ear portion and the speaker of the earbud not illustrated)

As shown in FIG. 1 and FIG. 2, the first sound guiding wall 1-7 is a partial annular wall which is adapted to the shape of the inner wall of the casing 1, such as the approximate "C" shape. The cover plate 4 is similar in shape to the first sound guiding wall 1-7 and also has an approximately "C" shape.

The acoustic structure further comprises a second sound guiding wall 1-8 which connects one end of the first sound guiding wall 1-7 to the inner wall of the casing 1, such that one end of the sound guiding groove 1-4 is open to communicate with the sound cavity 6, and the other end communicates with the aperture in the casing 1 and connects the inner wall of the casing 1 seamlessly, to constitute a bass pipe 8.

Since the earbud usually has an approximately cylindrical outer casing, the inner wall of the casing 1 also has an approximately annular shape. In order to adapt to the inner wall of the casing 1, the first sound guiding wall 1-7 is also designed as a partial annular wall, so that the space inside the rear sound cavity 6 can be reasonably used, the bass pipe 8 can also be extended to improve the bass effect of the earbud.

As shown in FIG. 3, the bass pipe 8 can be formed by combining the first sound guiding wall 1-7 with the inner wall of the casing. Since only the first sound guiding wall (alternatively, and a second guiding wall additionally provided) needs to be disposed in the rear sound cavity, the space of the rear sound cavity occupied by the entire bass pipe is reduced, so that the rear sound cavity 6 includes not only a first rear sound cavity 6-1 but also a second rear sound cavity 6-2. However, in the prior art, since the bass pipe is a separate pipe structure, it occupies the entire cavity space below the first rear sound cavity 6-1 in the rear sound cavity 6. Therefore, compared with the prior art, the present embodiment increases the space of the rear sound cavity and can effectively improve low frequency sound quality.

In an embodiment, a second sound guiding wall 1-8 of a linear shape is provided in the rear sound cavity 6. Two ends of the second sound guiding wall 1-8 are respectively connected to one end of the first sound guiding wall 1-7 and the inner wall of the casing 1, and the end of the first sound guiding wall 1-7 and the inner wall of the casing 1 is connected seamlessly, in combination with the cover plate, the bass pipe 8 communicates with the aperture in the casing 1.

The second sound guiding wall 1-8 is designed to have a linear shape, so that the bass pipe 8 can be kept to have a uniform width, and it is easier to design the shape of the cover plate 4 and cover the upper opening of the sound guiding groove 1-4. The second sound guiding wall 1-8 may also be designed to have an approximately arc shape, if the width uniformity of the bass pipe 8 is not affected.

The second sound guiding wall 1-8 may also be integrally formed with the first sound guiding wall 1-7 and the inner casing 1-10 in advance.

Further Optimized Design

In order to fix the cover plate 4 at the upper opening part of the sound guiding groove 1-4, in an embodiment of the present disclosure, a first step is provided on the inner wall of the casing 1 constituting the sound guiding groove 1-4. By the aid of the first step and the upper ends of the first sound guiding wall 1-7 and the second sound guiding wall 1-8, the cover plate 4 is mounted at the upper opening part of the sound guiding groove 1-4. In other words, the cover plate 4 is supported by the first step, and the upper ends of the first sound guiding wall 1-7 and the second sound guiding wall 1-8.

In the present embodiment, the cover plate 4 has a flat plate shape and a rectangular cross section.

Moreover, an adhesive may be provided at the edge of the cover plate 4 to reinforce the fixation.

In order to increase the coverage area of the adhesive and prevent the adhesive from affecting the area of the bass pipe, the top surface side of the cover plate 4 may be further provided as a stepped surface, in other words, the side adjacent to the inner wall of the casing 1 is provided as a stepped surface, and an adhesive is provided on the stepped surface to fix the cover plate 4 at the upper opening part of the sound guiding groove 1-4. The stepped surface saves a groove for dispensing an adhesive to facilitate providing the adhesive.

Further Optimized Design

The aperture in the casing 1 forms the earbud sound venting hole 1-3 of the earbud. The central axis of the earbud sound venting hole 1-3 is parallel with the bottom of the sound guiding groove 1-4, and is located between the bottom of the sound guiding groove 1-4 and the opening of the sound guiding groove 1-4. Such a design allows the sound to be smoothly transmitted from the earbud sound venting hole 1-3.

Since a sound venting hole should be provided in the rear sound cavity 6 mainly in order to balance the pressure between the rear sound cavity 6 and the outside, the aperture in the casing 1 can also communicate with the rear sound cavity sound venting hole 4-1 of the earbud while serving as the earbud sound venting hole 1-3. Thus, there is no need to separately provide another sound venting hole in the casing 1 to communicate with the rear sound cavity sound venting hole 4-1 in the cover plate 4.

Of course, according to design requirements of the earbud, another sound venting hole may be further provided separately on the casing 1 to communicate with the rear sound cavity sound venting hole 4-1 in the cover plate 4. In such a case, there will be two or more apertures in the casing 1.

Further Optimized Design

An end of the cover plate 4 which is close to the earbud sound venting hole 1-3 is provided with a rear sound cavity sound venting hole 4-1. The rear sound cavity sound venting hole 4-1 communicates with the earbud sound venting hole 1-3 through the sound guiding groove 1-4. The rear sound cavity sound venting hole 4-1 is covered with a tuning mesh 3.

As shown in FIG. 3, the tuning mesh 3 can be disposed under the cover plate 4 so that the fixing is more secure. The tuning mesh 3 may have a mesh number of 530 and a model number SATTIB080HY. The tuning mesh with an appropriate mesh number is usually selected according to acoustic simulation results and experimental test results.

The rear sound cavity sound venting hole 4-1 is also a sound venting passage of the rear sound cavity 6. The sound can be transmitted out of the casing 1 via the rear sound cavity sound venting hole 4-1, the sound guiding groove 1-4, and the earbud sound venting hole 1-3. The sound in the rear sound cavity 6 is not transmitted entirely from the bass pipe 8, but partially from the rear sound cavity sound venting hole 4-1 and partially from the bass pipe 8.

The earbud sound venting hole 1-3 is covered with an isolation mesh 5. The main function of the isolation mesh 5 is to prevent foreign objects from entering the earbuds via the earbud sound venting hole 1-3.

Further Optimized Design

The bottom surface 1-1 of the rear sound cavity is provided with a threading hole 1-2, In other words, a threading hole 1-2 is provided in the inner casing 1-10, and a wire 10 (FPC, i.e., a flexible cable) of the speaker 9 is taken from the threading hole 1-2.

The upper end of the wire 10 is connected to a voice coil in the speaker 9, and the lower end of the wire 10 is connected to the control circuit board of the earbud, thereby providing a control signal to the speaker 9 and controlling the speaker 9 to make sound.

Since the control circuit board is disposed outside the sound cavity, and the bottom of the sound cavity has the inner casing 1-10, it is necessary to reserve an access passage for the wire 10. The threading hole 1-2 functions as such an access passage.

In order to prevent the sound of the rear sound cavity 6 from leaking at the threading hole 1-2, the threading hole 1-2 should be sealed with an adhesive.

Further Optimized Design

The earbud in the present embodiment is an in-ear type earbud, so the casing 1 comprises a handle portion 1-12 and an in-ear portion 1-11. The sound cavity is disposed in the in-ear portion 1-11. The above mentioned speaker 9, front sound cavity 7, rear sound cavity 6, etc. are all located in the in-ear portion 1-11. The above mentioned inner casing 1-10 can be seen as the inner boundary between the handle portion 1-12 and the in-ear portion 1-11. The bass pipe 8 is located at the junction of the handle portion 1-12 and the in-ear portion 1-11.

A control circuit board, a battery, and the like may be disposed in the handle portion 1-12.

Further Optimized Design

As shown in FIG. 3, an arc-shaped concave portion is provided between the in-ear portion 1-11 and the handle portion 1-12. The earbud sound venting hole 1-3 is disposed in the arc-shaped concave portion and is located in a longitudinal central plane of the casing 1. The longitudinal central plane is the central plane along the longitudinal direction of the handle portion (the direction corresponding to the A-A line in FIG. 1). With such a design, the earbud sound venting hole 1-3 will not be blocked by the auricle of the human ear when the earbud is worn.

The above mentioned rear sound cavity sound venting hole 4-1 is also located in the longitudinal central plane of the casing 1, so that the sound is transmitted more smoothly between it and the earbud sound venting hole 1-3.

Second Embodiment

The second embodiment of the present disclosure differs from the first embodiment in that, a first step is provided on the inner wall of the casing 1 constituting the sound guiding groove 1-4, a second step is provided on the upper ends of the first sound guiding wall 1-7 and the second sound guiding wall 1-8, and by the aid of the first step and the second step, the cover plate 4 is mounted at the upper opening part of the sound guiding groove 1-4. In other words, the cover plate 4 is supported by the first step and the second step.

By providing the second step, a limiting structure is added to the cover plate 4, such that the cover plate 4 can be more easily mounted to the upper opening part of the sound guiding groove 1-4, and the installation is more secure.

In the present embodiment, the cover plate 4 has a flat plate shape and a rectangular cross section.

Moreover, the edge of the cover plate 4 should be fixed with an adhesive.

In order to facilitate coating the adhesive, both sides of the top surface of the cover plate 4 may be further formed with a stepped surface, and the adhesive is provided on the stepped surface to fix the cover plate 4 at the upper opening part of the sound guiding groove 1-4.

Other structures of the earbud in the present embodiment are the same as those in the first embodiment, which will not be repeated here.

Third Embodiment

The third embodiment differs from the first embodiment and the second embodiment in that, at least one third step is provided on the bottom surface of the cover plate 4.

At this point, the cover plate 4 may be mounted at the upper opening part of the sound guiding groove 1-4 by the aid of the first step, the upper ends of the first sound guiding wall 1-7 and the second sound guiding wall 1-8, and the third step. In other words, the cover plate 4 is supported by the first step, the upper ends of the first sound guiding wall 1-7 and the second sound guiding wall 1-8, and the third step.

Alternatively, the cover plate 4 is mounted at the upper opening part of the sound guiding groove 1-4 by the aid of the first step, the second step provided on the upper ends of the first sound guiding wall 1-7 and the second sound guiding wall 1-8, and the third step.

If one third step is provided on the bottom surface of the cover plate 4, the third step may be located on a side adjacent to the inner wall of the casing 1, or may be located on a side adjacent to the first sound guiding wall 1-7 and the second sound guiding wall 1-8.

If two third steps are provided on the bottom surface of the cover plate 4, the cross section of the cover plate 4 will be of an inverted convex (i) shape.

By providing the third step, a limiting structure is added to the cover plate 4, such that the cover plate 4 can be more easily mounted to the upper opening part of the sound guiding groove 1-4, and the installation is more secure.

Other structures of the earbud in the present embodiment are the same as those in the first embodiment, which will not be repeated here.

Fourth Embodiment

The fourth embodiment of the present disclosure differs from the first embodiment in that, the bottom surface 1-1 of the rear sound cavity is provided with a wire groove 1-5 for accommodating the folded portion of the wire 10 of the speaker 9, the wire groove 1-5 is located outside the sound guiding groove 1-4, and the wire groove 1-5 is formed by making the bottom surface 1-1 of the rear sound cavity recessed toward the rear sound cavity 6; a first threading hole 1-2 is provided at the top or lateral side of the wire groove 1-5, a second threading hole (not shown) is provided at the bottom of the wire groove 1-5, and the wire 10 of the speaker 9 comes out of the rear sound cavity 6 via the first threading hole 1-2 and the second threading hole.

Figure 4:
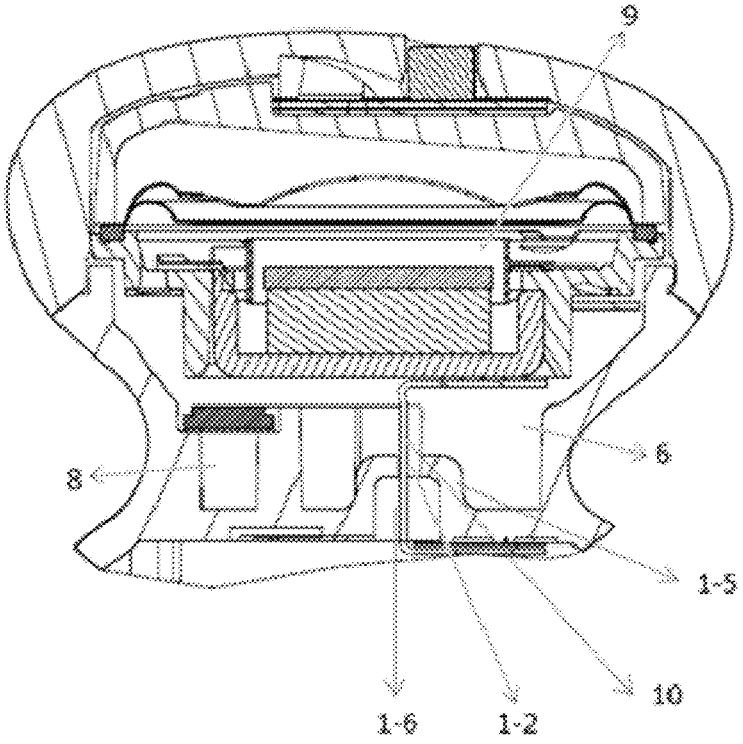
FIG. 4 is a partial cross sectional view taken along line B-B of FIG. 1.

As shown in FIG. 3 and FIG. 4, the opening of the wire groove 1-5 faces downward, and a convex structure is formed in the rear sound cavity. The bottom of the wire groove 1-5 is located at the opening below, which is a part of the bottom surface 1-1 of the rear sound cavity. The first threading hole 1-2 is provided at the top of the wire groove 1-5, i.e., the top of the convex structure. Of course, the first threading hole may be provided on the lateral side of the wire groove 1-5. The second threading hole is provided at the bottom of the wire groove 1-5. The wire 10 of the speaker 9 enters the wire groove 1-5 from the first threading hole 1-2 at the top of the wire groove 1-5, and then comes out via the second threading hole at the bottom of the wire groove 1-5 to connect a control circuit board of the earbud.

When the earbud is assembled, sometimes the wire 10 may be too long to be properly arranged inside the earbud. In such a case, the wire groove 1-5 may be used to accommodate a part of the wire 10 so as to optimize the internal space of the earbud.

The first threading hole 1-2 and the second threading hole should also be sealed with an adhesive.

In order to form a good seal, the wire groove 1-5 can simultaneously form a sealing solvent storage tank 1-6. The first threading hole 1-2 is disposed at the top of the sealing solvent storage tank 1-6, and the second threading hole is disposed at the bottom of the sealing solvent storage tank 1-6. A sealing solvent is added to the sealing solvent storage tank 1-6 to seal the first threading hole 1-2 and the second threading hole.

Other structures of the earbud in the present embodiment are the same as those in the first embodiment, which will not be repeated here.

The present disclosure fully takes advantage of the structure of the earbud casing 1 itself, and the bass pipe 8 can be formed only by adding the cover plate 4 and the wall-like structure in the rear sound cavity 6 without additionally installing a separate bass pipe, thereby reducing the internal space occupied by the conventional pipeline wall and satisfying the small size design requirements of the earbud; moreover, the space of the rear sound cavity 6 composed of the speaker 9 and the casing 1 is increased due to the reduction of the internal space occupation, which can effectively improve the bass sound quality of the earbud.

The above description is only embodiments of the present disclosure, and is not intended to limit the scope of the present disclosure. Any modifications, equivalent substitutions, improvements, extensions and the like made within the spirit and scope of the present disclosure should be included in the scope of the present disclosure.

What is claimed is:

1. An earbud, comprising:

a casing in which a sound cavity is provided;

a speaker disposed in the sound cavity and dividing the sound cavity into a front sound cavity and a rear sound cavity; and an acoustic structure located in the rear sound cavity, wherein the acoustic structure comprises a first sound guiding wall and a cover plate, the first sound guiding wall is attached to a bottom surface of the rear sound cavity and is configured to, together with at least a part of an inner wall of the casing, constitutes a sound guiding groove, and the cover plate is mounted at an upper opening part of the sound guiding groove, such that the sound guiding groove forms a bass pipe which communicates from the rear sound cavity to at least one aperture of the casing, wherein the aperture forms an earbud sound venting hole of the earbud, and a central axis of the earbud sound venting hole is parallel with a bottom of the sound guiding groove and is located between the bottom of the sound guiding groove and an opening of the sound guiding groove.

2. The earbud according to claim 1, wherein the first sound guiding wall is a partial annular wall adapted to a shape of the inner wall of the casing.

3. The earbud according to claim 1, wherein the first sound guiding wall is of a "C" shape.

4. The earbud according to claim 1, wherein the acoustic structure further comprises a second sound guiding wall which connects one end of the first sound guiding wall to the inner wall of the casing, such that one end of the sound guiding groove is open to communicate with the rear sound cavity, and the other end of the sound guiding groove communicates with the aperture and connects the inner wall of the casing seamlessly, which constitute the bass pipe.

5. The earbud according to claim 4, wherein the second sound guiding wall has a linear shape or an arc shape.

6. The earbud according to claim 1, wherein a first step is provided on the inner wall of the casing constituting the sound guiding groove; and the cover plate is mounted at an upper opening part of the sound guiding groove by the aid of the first step and upper ends of the first sound guiding wall and a second sound guiding wall.

7. The earbud according to claim 1, wherein a first step is provided on the inner wall of the casing constituting the sound guiding groove;

a second step is provided on upper ends of the first sound guiding wall and a second sound guiding wall; and the cover plate is mounted at an upper opening part of the sound guiding groove by the aid of the first step and the second step.

8. The earbud according to claim 1, wherein a first step is provided on the inner wall of the casing constituting the sound guiding groove;

at least one third step is provided on a bottom surface of the cover plate; and the cover plate is mounted at an upper opening part of the sound guiding groove by the aid of the first step, upper ends of the first sound guiding wall and a second sound guiding wall, and the third step.

9. The earbud according to claim 1, wherein at least one side of the cover plate is provided as a stepped surface, and an adhesive is provided on the stepped surface to fix the cover plate at an upper opening part of the sound guiding groove.

10. The earbud according to claim 1, wherein an end of the cover plate which is close to the earbud sound venting hole is provided with a rear sound cavity sound venting hole, and the rear sound cavity sound venting hole communicates with the earbud sound venting hole via the sound guiding groove.

11. The earbud according to claim 10, wherein the rear sound cavity sound venting hole is covered with a tuning mesh, and the earbud sound venting hole is covered with an isolation mesh.

12. The earbud according to claim 1, wherein a bottom surface of the rear sound cavity is provided with a threading hole, and a wire of the speaker comes out of the rear sound cavity via the threading hole.

13. The earbud according to claim 1, wherein a bottom surface of the rear sound cavity is provided with a wire groove for accommodating a wire of the speaker, the wire groove is located outside the sound guiding groove, and the wire groove is formed by making the bottom surface of the rear sound cavity recessed toward the rear sound cavity; and a first threading hole is provided at a top or a lateral side of the wire groove, a second threading hole is provided at a bottom of the wire groove, and the wire of the speaker comes out of the rear sound cavity via the first threading hole and the second threading hole.

14. The earbud according to claim 13, wherein the first threading hole and the second threading hole are sealed with an adhesive.

15. The earbud according to claim 13, wherein the wire groove forms a sealing solvent storage tank;

the first threading hole is provided at a top or a lateral side of the sealing solvent storage tank, and the second threading hole is provided at a bottom of the sealing solvent storage tank; and a sealing solvent is added to the sealing solvent storage tank to seal the first threading hole and the second threading hole.

16. The earbud according to claim 1, wherein the casing comprises a handle portion and an in-ear portion, and the speaker is disposed in the in-ear portion;

the bass pipe locates at a junction of the handle portion and the in-ear portion.

17. The earbud according to claim 16, wherein the junction of the handle portion and the in-ear portion is provided as an arc-shaped concave portion; and the aperture is disposed in the arc-shaped concave portion, the central axis of the aperture is located in a longitudinal central plane of the casing, and the longitudinal central plane is the central plane along a longitudinal direction of the handle portion.

* * * * *